US008671613B2

(12) United States Patent
Crilly et al.

(10) Patent No.: US 8,671,613 B2
(45) Date of Patent: Mar. 18, 2014

(54) TREE SLIDE

(76) Inventors: Michael G. Crilly, Hatboro, PA (US); Stephanie E. Crilly, Hatboro, PA (US)

( * ) Notice: Subject to any disclaimer, the term of this patent is extended or adjusted under 35 U.S.C. 154(b) by 1010 days.

(21) Appl. No.: 12/664,976

(22) PCT Filed: Mar. 3, 2009

(86) PCT No.: PCT/US2009/035788

§ 371 (c)(1),
(2), (4) Date: Dec. 16, 2009

(87) PCT Pub. No.: WO2009/114328

PCT Pub. Date: Sep. 17, 2009

(65) Prior Publication Data

US 2010/0175317 A1 Jul. 15, 2010

Related U.S. Application Data

(60) Provisional application No. 61/068,939, filed on Mar. 11, 2008, provisional application No. 61/107,874, filed on Oct. 23, 2008.

(51) Int. Cl.
*A47G 33/12* (2006.01)

(52) U.S. Cl.
USPC ..... 47/40.5; 47/42

(58) Field of Classification Search
USPC ..... 47/39, 40.5, 42–46; 248/511, 518–519, 248/523, 539
See application file for complete search history.

(56) References Cited

U.S. PATENT DOCUMENTS

| | | | | | |
|---|---|---|---|---|---|
| 2,337,914 | A | * | 12/1943 | Meldrum | 47/40.5 |
| 3,302,909 | A | * | 2/1967 | Glassman | 47/40.5 |
| 3,954,129 | A | * | 5/1976 | Rudell et al. | 206/423 |
| 4,126,963 | A | * | 11/1978 | Dunbar | 47/40.5 |
| 4,559,738 | A | * | 12/1985 | Helfman | 47/67 |
| 4,891,905 | A | * | 1/1990 | Stolz | 47/65.8 |
| 4,976,411 | A | * | 12/1990 | Gordon et al. | 248/524 |
| 5,482,178 | A | * | 1/1996 | Cohu | 220/628 |
| 5,593,743 | A | | 1/1997 | Baker | |
| 5,707,037 | A | * | 1/1998 | Pastrick | 248/516 |
| 5,893,547 | A | * | 4/1999 | Cohen, Jr. | 248/521 |
| 6,019,341 | A | * | 2/2000 | Brown et al. | 248/516 |
| 6,041,545 | A | * | 3/2000 | Sofy et al. | 47/40.5 |
| 6,094,859 | A | * | 8/2000 | Kalman et al. | 47/40.5 |
| 6,129,325 | A | * | 10/2000 | Niklas | 248/523 |
| 6,572,069 | B1 | | 6/2003 | Kotthaus | |
| 6,681,519 | B2 | | 1/2004 | Cone | |
| 6,808,071 | B2 | * | 10/2004 | Brown | 206/525 |
| 6,877,274 | B2 | * | 4/2005 | Fiveash | 47/40.5 |
| 7,131,621 | B2 | * | 11/2006 | Welzen | 248/514 |
| 7,597,304 | B1 | * | 10/2009 | Gray | 248/523 |
| 7,600,342 | B2 | * | 10/2009 | Fiveash | 47/40.5 |
| 7,752,806 | B2 | * | 7/2010 | Krinner | 47/40.5 |
| 2005/0257422 | A1 | | 11/2005 | Hronyetz | |

* cited by examiner

*Primary Examiner* — David Parsley

(57) ABSTRACT

A tree slide facilitating movement of a Christmas tree via sliding along a support surface without damage to the surface is described. The tree slide includes a central region of substantially planar extent and an arcuate perimeter which surrounds and extends from the central region. The arcuate perimeter forms a cavity along one side of the tree slide. In some embodiments, a rim is provided which extends from the arcuate perimeter opposite of the central region. In other embodiments, the tree slide could also include a cover, composed of a stretchable and conformable material, which conceals a tree stand and the tree slide.

12 Claims, 8 Drawing Sheets

TREE SLIDE

CROSS REFERENCE TO RELATED APPLICATIONS

This application is based upon and claims priority from U.S. Provisional Application Nos. 61/068,939 filed Mar. 11, 2008 and 61/107,874 filed Oct. 23, 2008 and PCT Application No. PCT/US2009/035,788 filed Mar. 3, 2009, all entitled Tree Slide, which are hereby incorporated in their entirety by reference thereto.

FEDERALLY SPONSORED RESEARCH AND DEVELOPMENT

None.

BACKGROUND OF THE INVENTION

1. Field of the Invention

The invention generally relates to a device facilitating movement of a Christmas tree via sliding along a support surface without damage thereto. Specifically, the invention includes a pliable and resilient mat-like element having an arcuate perimeter and an optional cover to conceal the tree slide and stand thereon.

2. Background

The winter holidays often include the purchase and decoration of a Christmas tree. The tree is placed within a stand to support it in an upright orientation. Thereafter, the tree is decorated by hanging ornaments and the like across a vast majority of the circumference of the tree. As such, it is desirous that the tree be located away from walls and the like. Upon completion of the decoration process, the tree is then lifted, ever so gently, and placed in a corner formed by two or more walls or along a single wall. The act of lifting a tree is responsible for many skeletal and muscular injuries, including, but not limited to, regions involving the back, neck, legs and arms.

As is readily apparent from the discussions above, the related arts do not include a device which facilitates movement and placement of a Christmas tree within a room prior to and after decoration that does not require the tree to be physically lifted.

Therefore, what is required is a sliding device which facilitates the movement of a tree prior to and after decoration along a horizontal surface.

SUMMARY OF THE INVENTION

An object of the invention is to provide a sliding device which facilitates the movement of a tree prior to and after decoration along a horizontal surface.

The tree slide includes a central region of substantially planar extent and an arcuate perimeter which surrounds and extends from the central region. The arcuate perimeter forms a cavity along the lower side of the tree slide. In some embodiments, a rim is provided which surrounds and extends from the arcuate perimeter opposite of the central region.

In other embodiments, the cavity avoids compression of a structure, one example being carpet, disposed along a horizontal surface so as to secure the tree slide along the horizontal surface after proper placement of a tree.

In yet other embodiments, the arcuate perimeter is sufficiently raised above the central region so as to contain a fluid disposed along the central region.

In yet other embodiments, both central region and rim are aligned in a horizontal fashion.

In yet other embodiments, the rim extends below the central region so as to deflect when the tree slide is placed on a horizontal surface. In preferred embodiments, the tree slide provides a vacuum adjacent to the cavity so as to secure the tree slide to the horizontal surface.

In yet other embodiments, the tree slide includes a cover, composed of a stretchable and conformable material, which conceals a tree stand and the tree slide.

In yet other embodiments, the cover includes a pocket about the perimeter of the cover and includes an elastic element which is shorter than the perimeter.

The described invention provides advantages over the related arts. The invention facilitates movement of a tree without lifting, thereby minimizing the displacement of ornaments and lights hung on the tree. The invention secures a tree along a horizontal surface after placement. The invention facilitates movement of a tree via sliding without damage to carpet, tile, linoleum or other floor surfaces. The invention is compatible with a wide variety of tree stand designs.

The above and other objectives, features, and advantages of the preferred embodiments of the invention will become apparent from the following description read in connection with the accompanying drawings, in which like referenced numerals designate the same or similar elements.

BRIEF DESCRIPTION OF THE INVENTION

Additional aspects, features, and advantages of the invention will be understood and will become more readily apparent when the invention is considered in the light of the following description made in conjunction with the accompanying drawings.

Figure 8A:
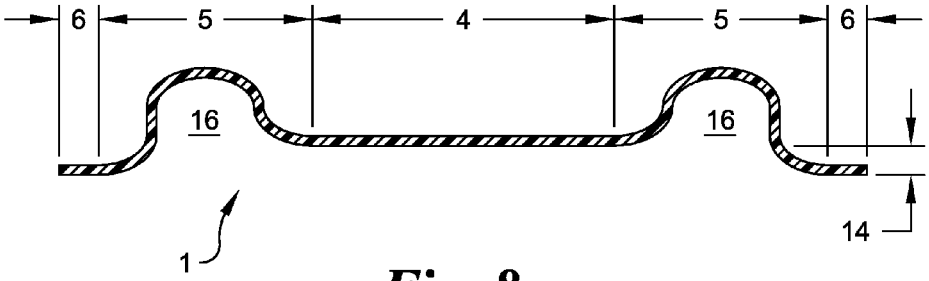

FIG. 8*a* is a cross section view illustrating a rim which extends below the central region in accordance with one embodiment of the invention.

Figure 8B:
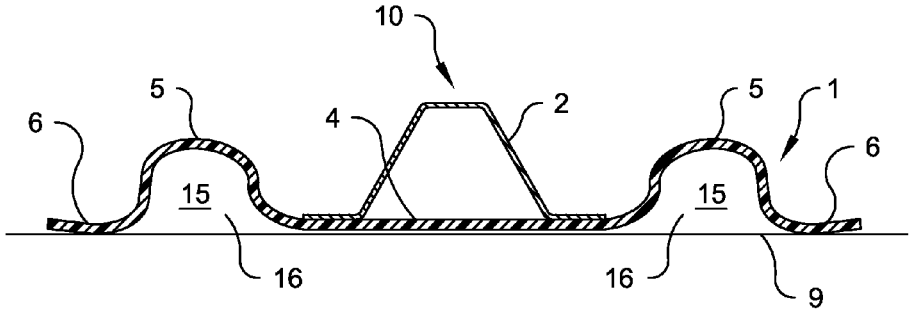

FIG. 8*b* is a cross section view illustrating deflection of the rim and arcuate perimeter when placed on a horizontal surface and the formation of an optional vacuum between tree slide and horizontal surface in accordance with one embodiment of the invention.

Figure 9:
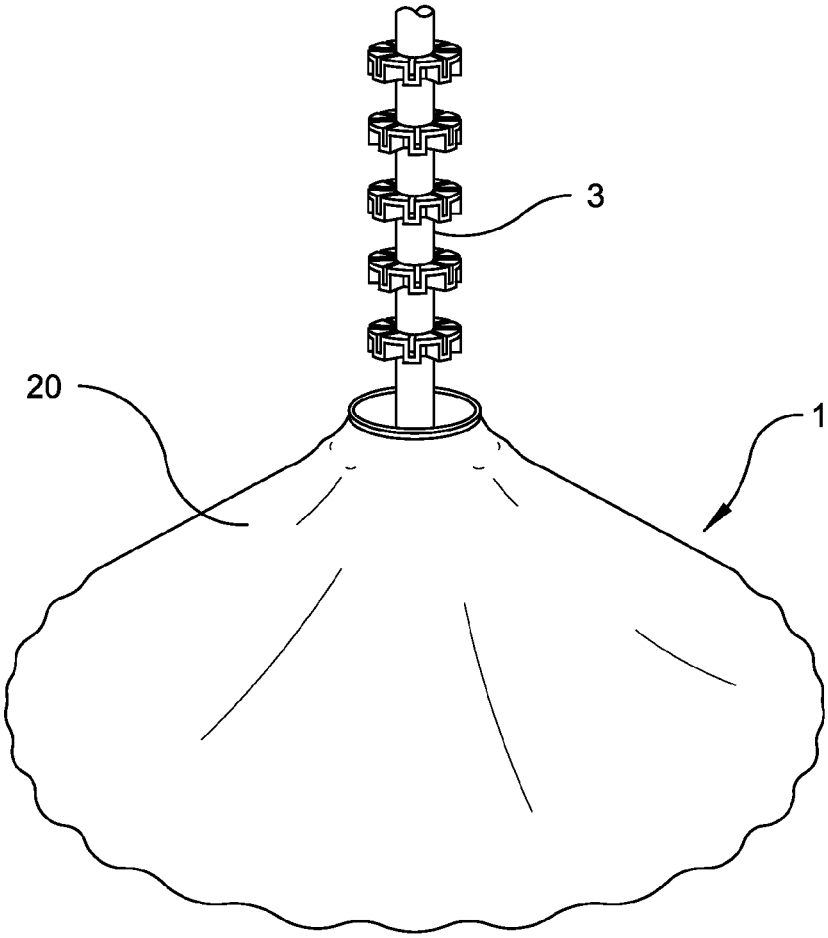

FIG. 9 is a perspective view illustrating a cover disposed about and covering a tree stand and tree slide.

Figure 10:
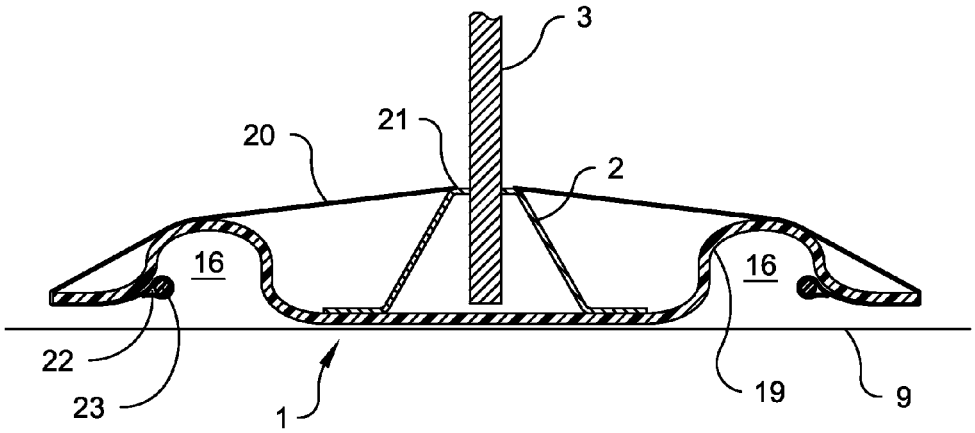

FIG. 10 is a cross section view illustrating a cover attached about a tree slide and tree stand so that the stretchable perimeter of the cover resides along the bottom surface of the slide in accordance with one embodiment of the invention.

DETAILED DESCRIPTION OF THE INVENTION

Reference will now be made in detail to several preferred embodiments of the invention that are illustrated in the accompanying drawings. Wherever possible, same or similar reference numerals are used in the drawings and the description to refer to the same or like parts or steps. The drawings are in simplified form and are not to precise scale.

Figure 1:
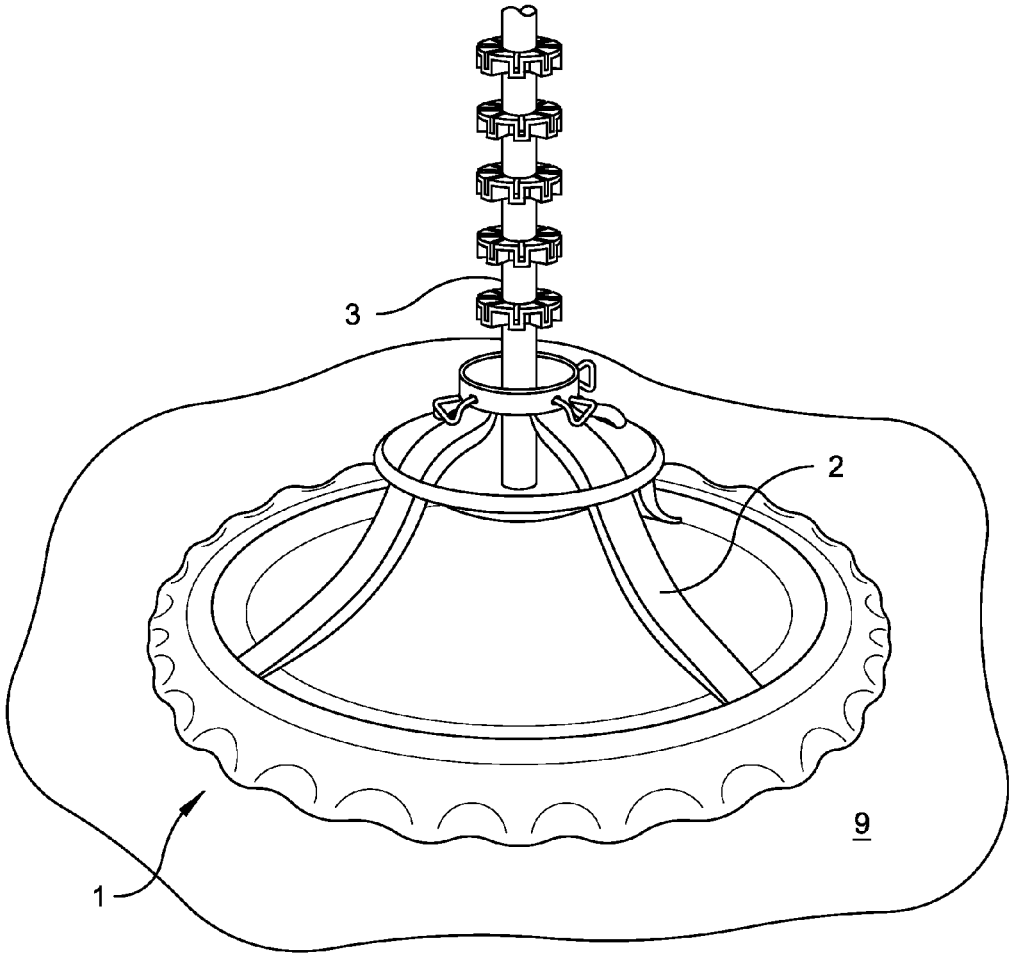
FIG. 1 is a perspective view illustrating the tree slide disposed between a tree stand supporting a tree structure and a horizontal surface in accordance with one embodiment of the invention.
Figure 2:
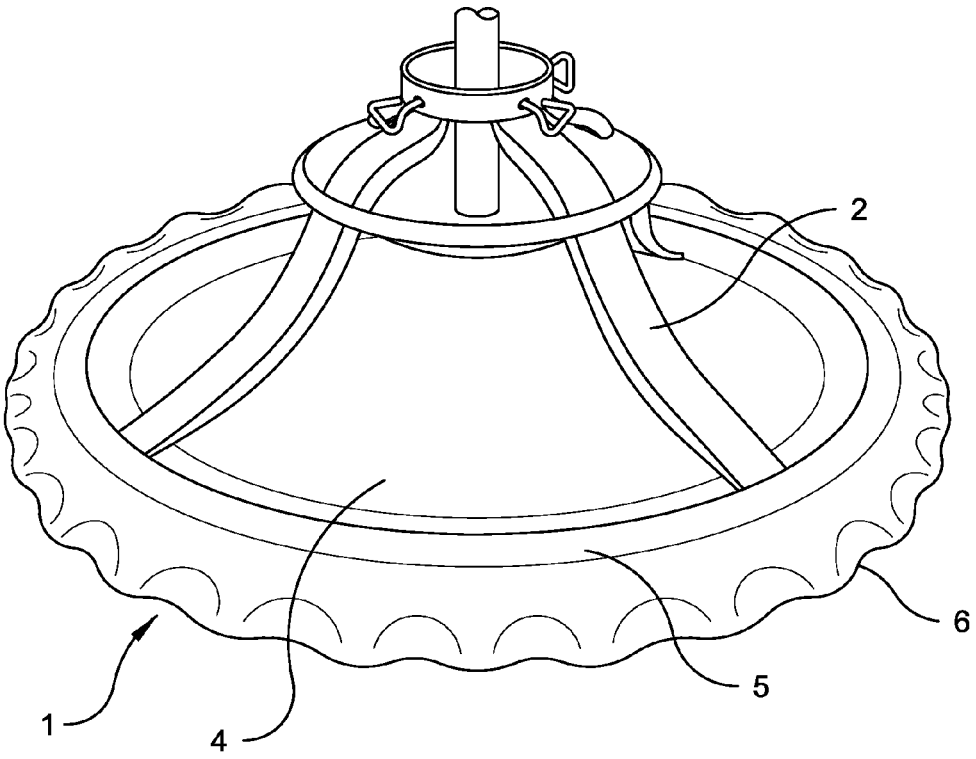
FIG. 2 is a perspective view illustrating an arcuate perimeter disposed about a central region and an optional rim disposed about the arcuate perimeter of the tree slide in accordance with one embodiment of the invention.
Figure 3:
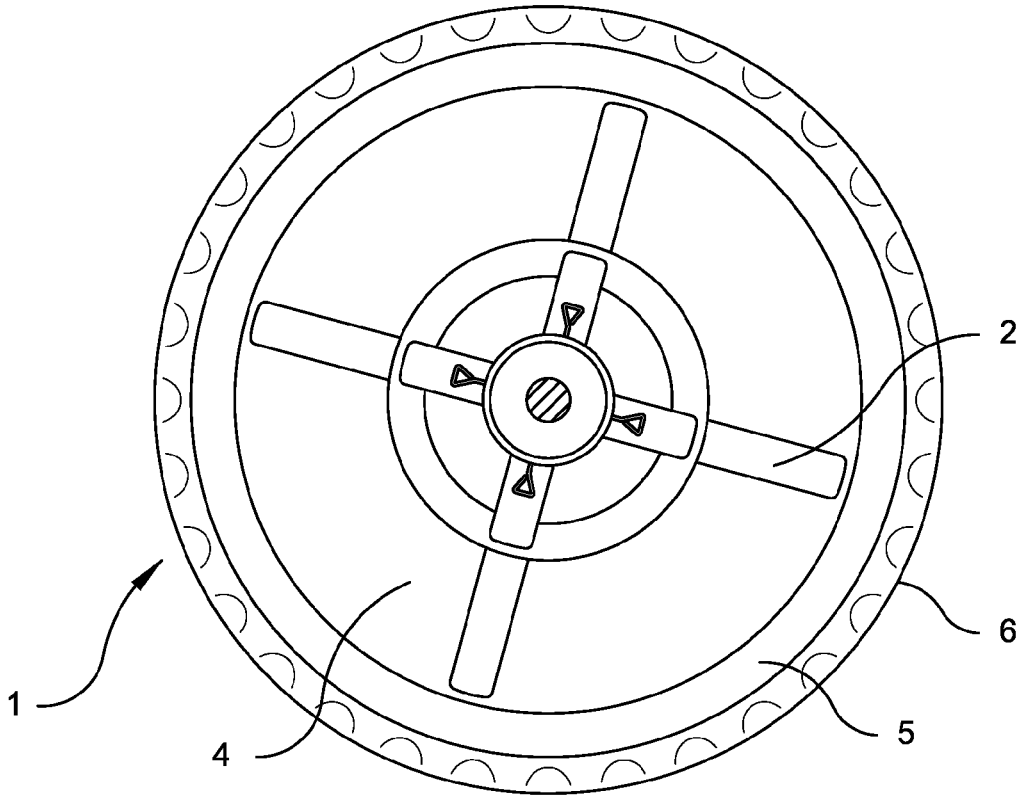
FIG. 3 is a top plan view illustrating the central region, arcuate perimeter, and rim of a tree slide in accordance with one embodiment of the invention.

Referring now to FIGS. 1-4, the invention, generally referred to as a tree slide 1, is composed of a unitary structure having a substantially planar central region 4, an arcuate perimeter 5, and an optional rim 6 arranged in the order described. The central region 4, arcuate perimeter 5, and rim 6 could form a circular element as shown in FIGS. 1-3 or any other shape including, but not limited to, an ellipse or polygon.

Figure 4:
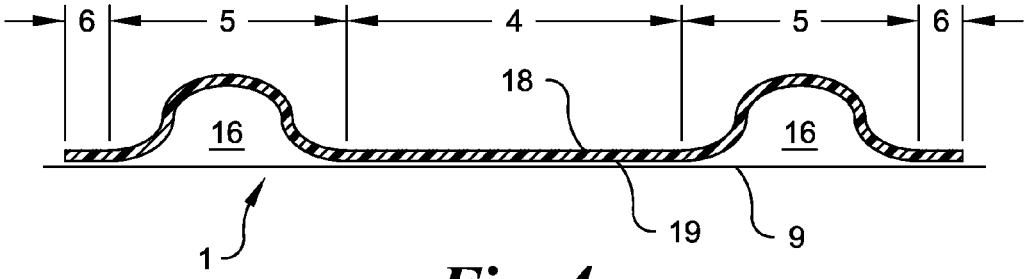
FIG. 4 is a cross section view illustrating the central region, arcuate perimeter, and rim of a tree slide in accordance with one embodiment of the invention.

The arcuate perimeter 5 could be a structure with a shaped cross section, examples including, but not limited to, u-shapes and v-shapes, which forms a cavity 16 along the lower surface of the tree slide 1, as represented in FIG. 4. The arcuate perimeter 5 is disposed about the perimeter of the central region 4. It is preferred for the arcuate perimeter 5 to extend above the central region 4 so as to form a basin within which water or a fluid is contained when spilled during watering of a tree. Also, it is preferred for the central region 4 to be at least as wide as the base dimensions of a tree stand 2 without contacting the arcuate perimeter 5. Further, it is preferred for the arcuate perimeter 5 to be located about the central region 4 so as to minimize or avoid relative motion between tree slide 1 and tree stand 2 as the tree slide 3 is moved along a horizontal surface 9.

Referring again to FIG. 4, the central region 4 is a planar structure which contacts and is attached to one end of the arcuate perimeter 5. In FIG. 4, the arcuate perimeter 5 is a ring-shaped structure, although other shapes are possible including, but not limited to, curves, ellipses and polygons. The optional rim 6 is also a substantially planar structure which contacts and is attached to the arcuate perimeter 5 opposite of the central region 4. The central region 4, arcuate perimeter 5, and rim 6 are preferred to be composed of a material with uniform thickness. However, in some embodiments it could be preferred to vary the thickness of each region to alter the stiffness or bending characteristics along the tree slide 1.

The tree slide 1 could be composed of a plastic which is formable via methods understood in the molding arts. For example, the tree slide 1 could be formed by hot pressing a planar sheet of polyethylene or polypropylene within a die set having the substantially planar shapes of the central region 4 and rim 6 and arcuate shape of the arcuate perimeter 5. Other cross sectional shapes are possible for the arcuate perimeter 5, including linear and curved designs. In some embodiments, it could be preferred to texture the upper surface 18 of the tree slide 1 or apply a non-skid layer to reduce sliding between tree stand 2 and central region 4 as the tree slide 1 is moved along a surface in a sliding motion. In yet other embodiments, it could be preferred to apply a low friction coating, examples including, but not limited to, polytetrafluourethylene and polyethylene, along the lower surface 19 of the central region 4 to reduce friction between the tree slide 1 and a horizontal surface 9.

Figure 5:
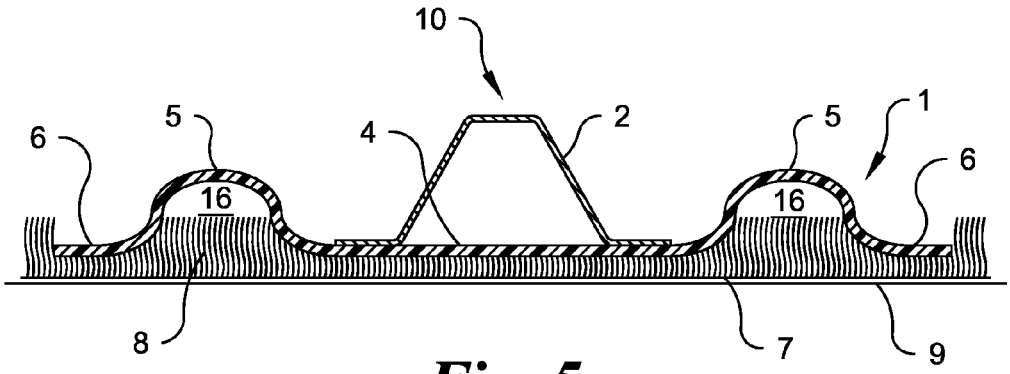
FIG. 5 is a cross section view illustrating the tree slide supported along a horizontal surface covered by carpet and showing the pile uncompressed within the cavity under the arcuate perimeter structure and compressed along the central region and rim.

Referring now to FIG. 5, a preferred embodiment of the tree slide 1 is shown resting on a horizontal surface 9 and contacting a carpet 7. A force 10 is applied onto the tree slide 1 by a tree structure 3 via the tree stand 2 causing compression of the pile 8 along the carpet 7 beneath the central region 4 and rim 6. The pile 8 beneath the arcuate perimeter 5 could remain uncompressed so as to fill the cavity 16 formed by the arcuate perimeter 5. This arrangement ensures that the tree slide 1 resists further sliding motion after a tree is properly positioned along a floor covered by carpet 7 or the like.

Figure 6:
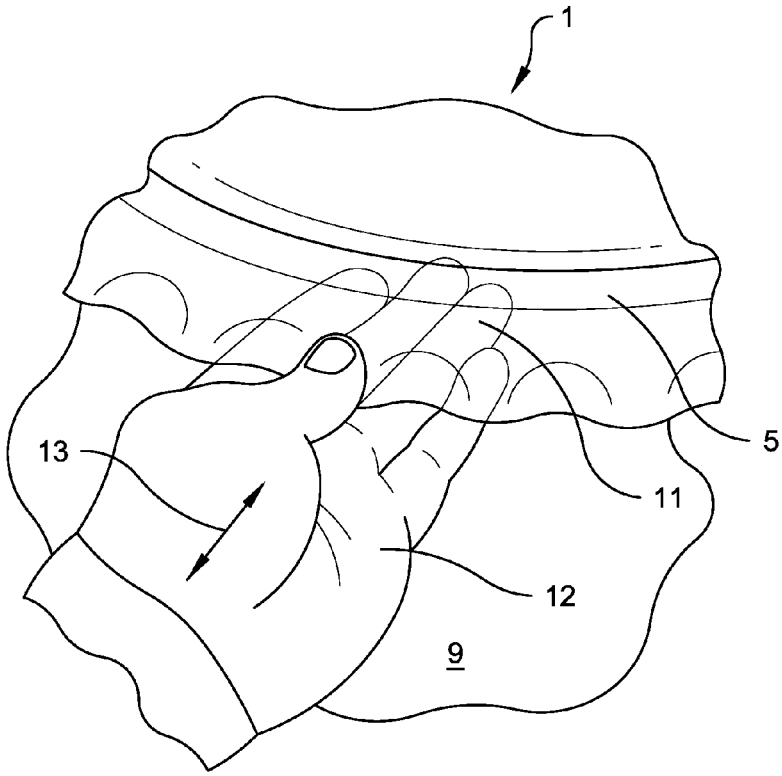
FIG. 6 is an enlarged elevation view illustrating a hand contacting and deflecting the rim and arcuate perimeter for application of a sliding force in accordance with one embodiment of the invention.

Referring now to FIG. 6, one edge of the tree slide 1 is shown whereby a hand 12 and fingers 11 are placed under the tree slide 1 and the rim 6 and arcuate perimeter 5 are deflected upwards away from a horizontal surface 9. The tree slide 1 is preferred to be composed of a pliable or bendable material which allows for deflection of the arcuate perimeter 5 and/or rim 6 by a hand 12 and fingers 11, yet which is sufficiently resilient so as to return to its original shape after distorting forces are removed. The arcuate perimeter 5 and/or rim 6 are grasped by hand 12 and fingers 11 and a sliding force 13 is applied for movement of the tree slide 1 in a sliding fashion along a horizontal surface 9.

Figure 7:
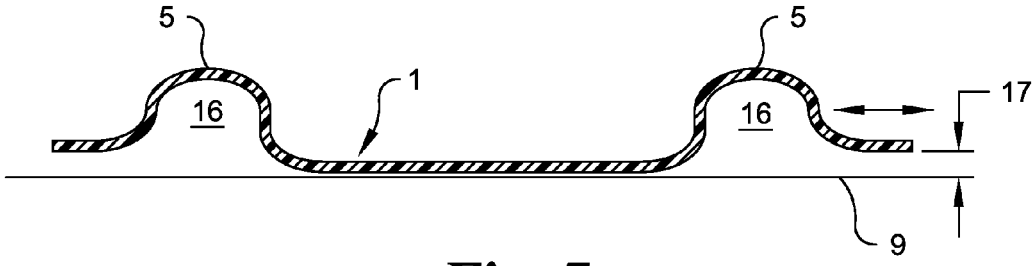
FIG. 7 is cross section view illustrating an offset of the outer circumference of the arcuate perimeter to avoid contact with a horizontal surface in accordance with one embodiment of the invention.

Referring now to FIG. 7, an alternate embodiment is shown whereby the outer circumference of the tree slide 1 is disposed at an offset 17 above a horizontal surface 9. The gap formed by the offset 17 facilitates the insertion of fingers 11 into the cavity 16 under the arcuate perimeter 5.

Referring now to FIGS. **8*a*-8*b*, an alternate embodiment is shown whereby the rim 6 and outer portion of the arcuate perimeter 5 extend below the central region 4 by an offset 14. The placement of this embodiment along a horizontal surface 9 and application of a force 10 by a tree structure 3 via a tree stand 2 causes both rim 6 and arcuate perimeter 5 to deflect so as to conform to the horizontal surface 9. When the horizontal surface 9 is a smooth surface, examples including, but not limited to, wood, linoleum, or tile, air between tree slide 1 and horizontal surface 9 is expelled so as to form a low pressure field 15 therein. This low pressure field 15 could be sufficient to prevent sliding motion between tree slide 1 and a floor after proper placement. The vacuum described here is relieved by slightly lifting the tree in an upward direction relative to the horizontal surface 9 or by inserting a finger 11 or hand 12 under the rim 6**.

Referring now to FIGS. 9-10, the tree slide 1 could also include a cover 20 which conceals the tree slide 1 and tree stand 2. The cover 20 could be composed of a fabric material which is stretchable or conformable, one example being spandex. The cover 20 could include an opening 21 through which the tree structure 3 extends through. The cover 20 could also include a pocket 22 disposed about its perimeter or outer circumference. The pocket 22 could be formed by folding a portion of the cover 20 onto itself and sewing or fastening the layered material. A cord 23 or a stretchable elastic-like element could reside within the pocket 22. The cord 23 is preferred to be composed of a stretchable construction and have a total length less than the outer diameter of the tree slide 1.

Referring again to FIG. 10, the cover 20 is placed onto the tree slide 1 and a tree is inserted and fastened to the tree stand 2. Thereafter, the perimeter of the cover 20 is stretched or pulled and then placed under the tree slide 1 so as to contact its lower surface 20. It is preferred for the pocket 22 with cord 23 to reside within the cavity 16 under the arcuate perimeter 5. The cover 20 could include a variety of designs or ornamentation.

As is evident from the explanation above, the described tree slide is applicable to a wide variety of tree stands used to support a decorative tree during the Christmas holidays. The tree slide has both functional and decorative features with benefit within residential, commercial, and business settings.

The description above indicates that a great degree of flexibility is offered in terms of the invention. Although the invention has been described in considerable detail with reference to certain preferred versions thereof, other versions are possible. Therefore, the spirit and scope of the appended claims should not be limited to the description of the preferred versions contained herein.

What is claimed is:

1. A tree slide comprising:

(a) a central region of substantially planar extent, said central region sufficiently large to support a tree stand;

(b) an arcuate perimeter which surrounds and extends from said central region, said arcuate perimeter forming a cavity there under; and (c) a rim which extends from said arcuate perimeter opposite of said central region, said rim and said arcuate perimeter being pliable and resilient and deformable when a load is applied via a hand whereby said rim and said arcuate perimeter when deformed facilitate sliding of said tree slide and said tree stand along a surface.

2. The tree slide of claim 1, wherein said cavity avoids compression of a covering disposed along said surface so as to secure said tree slide along said surface.

3. The tree slide of claim 2, wherein said covering is a carpet.

4. The tree slide of claim 1, wherein said arcuate perimeter is sufficiently raised above said central region so as to contain a fluid contacting said central region.

5. The tree slide of claim 1, wherein said central region and said rim are aligned so as to contact said surface.

6. The tree slide of claim 1, wherein said rim extends below said central region so as to deflect when said tree slide is placed onto said surface.

7. The tree slide of claim 1, further comprising:

(c) an anti-skid layer along one side of said tree slide.

8. The tree slide of claim 1, further comprising:

(c) a low-friction layer along one side of said tree slide.

9. The tree slide of claim 1, further comprising:

(c) a cover which conceals said tree stand and said tree slide, said cover composed of a stretchable and conformable material and having an opening facilitating attachment of a tree to said tree stand.

10. The tree slide of claim 9, wherein said cover is a fabric.

11. The tree slide of claim 9, wherein said cover includes a pocket about the perimeter of said cover and an elastic element which is shorter than the perimeter of said cover.

12. The tree slide of claim 10, wherein said elastic element is a cord.

* * * * *

UNITED STATES PATENT AND TRADEMARK OFFICE

CERTIFICATE OF CORRECTION

PATENT NO. : 8,671,613 B2
APPLICATION NO. : 12/664976
DATED : March 18, 2014
INVENTOR(S) : Michael G. Crilly et al.

It is certified that error appears in the above-identified patent and that said Letters Patent is hereby corrected as shown below:

In the Claims

Col. 6 line 15
Delete "(c)" and insert --(d)--
Col. 6 line 17
Delete "(c)" and insert --(d)--
Col. 6 line 19
Delete "(c)" and insert --(d)--
Col. 6 line 27
Delete "10" and insert --11--

Signed and Sealed this
Second Day of September, 2014

Michelle K. Lee

Michelle K. Lee
*Deputy Director of the United States Patent and Trademark Office*